US005174822A

United States Patent [19]

Nabhan et al.

[11] Patent Number: 5,174,822

[45] Date of Patent: Dec. 29, 1992

[54] STEEL STRIP ANNEALING AND COATING APPARATUS

[75] Inventors: George A. Nabhan, Porter, Ind.; Naohiko Ide, Fukuyama, Japan

[73] Assignee: National Steel Corporation, Mishawaka, Ind.

[21] Appl. No.: 637,125

[22] Filed: Jan. 3, 1991

[51] Int. Cl.[5] ..... B05C 3/152; B05C 11/06

[52] U.S. Cl. ..... 118/33; 118/63; 118/67; 118/69; 118/419; 118/424; 72/47; 266/107

[58] Field of Search ..... 118/33, 63, 67, 69, 118/419, 424, 428, 503; 266/277, 107, 112; 72/47, 17, 200, 205

[56] References Cited

U.S. PATENT DOCUMENTS

| | | | |
|---|---|---|---|
| 3,622,140 | 11/1971 | Schwestka et al. | 266/3 |
| 3,766,767 | 10/1973 | Rastelli | 72/249 |
| 3,841,557 | 10/1974 | Atkinson | 239/11 |
| 3,924,428 | 12/1975 | Noe | 72/205 |
| 3,962,894 | 6/1976 | Noe et al. | 72/205 |
| 3,988,914 | 11/1976 | Metcalfe et al. | 72/342.1 |
| 4,358,093 | 11/1982 | Shimoyama et al. | 266/103 |
| 4,363,471 | 12/1982 | Yanagishima et al. | 266/111 |
| 4,519,337 | 5/1985 | Ono et al. | 118/33 |
| 4,704,167 | 11/1987 | Ichida et al. | 148/153 |
| 4,761,530 | 8/1988 | Scherer et al. | 219/10.71 |
| 4,913,748 | 4/1990 | Sellitto | 148/128 |

*Primary Examiner*—W. Gary Jones
*Assistant Examiner*—Todd J. Burns
*Attorney, Agent, or Firm*—James L. Bean

[57] ABSTRACT

A continuous hot dip galvanizing line for coating steel strip includes a continuous annealing furnace for annealing the strip before discharging the strip directly into the molten coating metal and a broad based bridle is located in the final cooling zone of the furnace. The broad based bridle includes at least two spaced bridle rolls each of which is independently driven and controlled to produce a more uniform tensile load in the strip and improve strip stability and coating quality in the final product.

5 Claims, 1 Drawing Sheet

STEEL STRIP ANNEALING AND COATING APPARATUS

BACKGROUND OF THE INVENTION

1. Field of the Invention

This invention relates to metallurgical apparatus, and more particularly to continuous steel strip annealing and coating apparatus.

2. Description of the Prior Art

In the continuous hot dip coating of metal strip, for example, the hot dip galvanizing or galvannealing of steel strip, it is conventional practice to continuously clean and anneal the cold rolled steel strip and pass it directly from the annealing furnace into a pot of molten coating metal through a chute containing a controlled or reducing atmosphere while the strip is still at or near the temperature of the molten coating metal. One continuous annealing furnace suitable for use in such an operation is shown in U.S. Pat. No. 3,622,140 and includes a cleaning zone for removing rolling oil and other contaminants from the strip surface and a plurality of heating zones wherein the strip is successively preheated, soaked, slow cooled, fast cooled, and held at the various temperatures for the times which make up the desired annealing cycle.

The annealed strip passes from the furnace into the molten coating metal bath where it is guided around a submerged sink roll then upwardly past a pair of guide or deflector rolls before emerging and passing between a pair of opposed air knives or coating thickness control nozzles where excess liquid coating material is removed as shown, for example, in U.S. Pat. No. 3,841,557. The coated strip may be contacted by a stabilizing roll, or a pair of such rolls, immediately above the air knives, but generally is not contacted as it passes vertically from the coating pot through a cooling zone for a distance sufficient to permit the liquid metal coating to solidify. In a galvannealing operation, the strip with the liquid metal coating adhering thereto passes into a second heating furnace such as the induction heating furnace shown in U.S. Pat. No. 4,761,530 where the temperature is quickly increased to a level to permit alloying of the coating metal with iron from the steel substrate before passing into the cooling zone.

At the top of the cooling zone, which may be up to 100 feet or more above the air knives, the coated strip passes over a cooled top guide roll from which it is withdrawn for further cooling and processing. The unsupported length of strip moving between the deflector roll in the coating metal bath (or the stabilizing rolls, if used), and the top guide roll tends to undulate or whip in a direction substantially perpendicular to its opposed surfaces and such movement (hereinafter sometimes referred to as vibrations) can be so severe as to cause defects in the coating. For example, movement of the strip toward one of the opposed air knives will reduce the coating thickness on that side and simultaneously increase the thickness on the opposing side, and such thickness variations depend on the extent of such movement. Further, rapid or excessive vibration of the strip as it emerges from the molten metal bath may result in spatter which can adhere to the coating thickness control nozzles and adversely effect their operation. This problem has become more critical in recent years with the increased use of hot dip coated steel strip in products such as automobiles having painted surfaces where even very minor variations in the metal coating can produce unacceptable blemishes in the finished surface. Further, in recent years the cost of zinc and zinc alloy coating metals used in hot dip galvanizing has greatly increased so that accurate control of the coating thickness can produce substantial savings.

Vibrations and undulations of the coated strip moving through a galvannealing furnace or through the cooling chamber also impose limitations on the operation. For example, excessive movement of the strip can result in contact between the strip and in coils or other structure of induction galvanneal furnaces and may result in uneven alloying of the coating. Also, in the cooling chamber, cooling fluid is directed onto the surface of the strip and excessive movement can result in uneven cooling or even contact between the strip and fixed structure in the cooling chamber.

In order to minimize vibration, it is desired to maintain the coated strip under relatively high tensile loads between the annealing furnace and the top guide roll. It has been found, however, that variations in the tensile load can induce or aggravate whipping, and can establish harmonic vibrations or wave motions so severe as to produce unacceptable product.

It is known to employ bridles to control the tensile load in strip moving through a continuous annealing furnace in order to maintain proper tracking and operating conditions within the furnace. Care must be taken, however, not to cause elongation of the strip in the high temperature section where the tensile load generally must be lower than is desired through the coating section of the line. It has been known, for example from U.S. Pat. No. 4,358,093, to provide bridles in the annealing furnace to isolate the tensile load in various sections of the furnace. Such bridles, when employed, conventionally have been of the short coupled two- or three-roll type utilizing a single SCR controller for all the bridle roll motor and drive mechanisms of each bridle. Such bridles installed in an annealing furnace substantially increase the overall size of the furnace, however, and may not be practical where space is a primary concern. In existing continuous annealing furnaces and hot dip coating installations, expanding an existing continuous annealing furnace to install a bridle in the final cooling zone will generally require moving the entire furnace since the hot dip coating pot and the cooling tower section of the building cannot readily be moved. It has been estimated that installing a conventional two-roll bridle in a continuous annealing oven of the type shown, for example, in U.S. Pat. No. 3,622,140 would increase the length of the oven by at least twelve feet and modification to the furnace alone would require capital expenditure of more than $1,000,000.00.

It has also been found that conventional bridles employing a single SCR controller for controlling all of the bridle roll drive motors do not provide the degree of tension control desired for a commercial high speed hot dip metal strip coating operation. Accordingly, there exists a need for improving the control of the tensile load in and the stability of steel strip in a hot dip galvanizing line above the coating metal bath until the coating has solidified. It is therefore a primary object of the present invention to provide an improved annealing and coating apparatus for use in a hot dip galvanizing line which will result in a more stable strip moving through the line and produce a more uniform quality of coated product.

It is a further object of the invention to provide an improved broad based bridle in the final cooling stage of the annealing furnace to provide a more uniform tensile load in the strip being galvanized while avoiding any increase in the overall size of the furnace.

SUMMARY OF THE INVENTION

The foregoing and other objects and advantages of the invention are achieved in accordance with the present invention wherein the continuous annealing oven includes broad based bridle means in the final or fast cooling chamber of the oven to provide a more uniform high tensile load in the annealed strip passing into the coating bath.

The broad base bridle comprises a plurality of bridle rolls which replace the conventional guide rolls in the furnace chamber with the bridle rolls being spaced apart along the path of the strip a distance at least substantially equal to the spacing of successive guide rolls in the chamber. Each bridle roll of the broad base bridle means is driven by a separate motor and reduction gear, with each drive motor being controlled by a separate SCR controller. The use of separate controllers and drives for each bridle roll enables a more accurate control of the tensile load change applied by each roll. At the same time, the use of separate controllers substantially eliminates fluctuations or variations in total load which can initiate or aggravate strip undulations or vibrations in the unsupported section of strip above the coating pot. The spaced bridle rolls permit cooling of the strip in the same manner and at the same rate as conventional guide rolls so that no increase in furnace size or shape is required. Preferably the bridle rolls are of cast nodular iron and steel construction with a coating of tungsten carbide on the outer roll surface to provide the desired coefficient of friction and wear resistance.

BRIEF DESCRIPTION OF THE DRAWINGS

The foregoing and other features and advantages of the invention will be apparent from the detailed description contained hereinbelow, taken in conjunction with the drawings, in which.

DESCRIPTION OF THE PREFERRED EMBODIMENT

Figure 1:
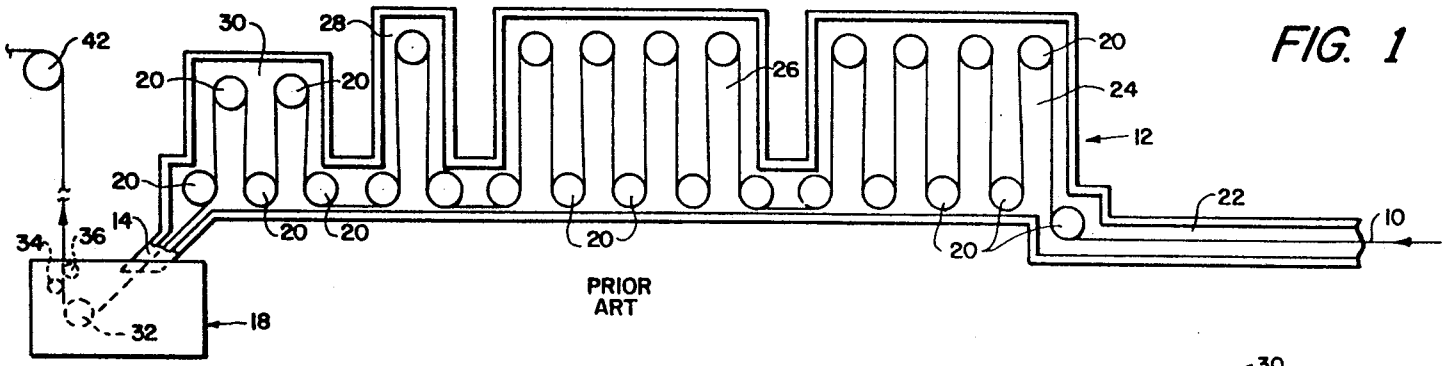
FIG. 1 is a fragmentary elevation view, partially in section, schematically showing a prior art continuous strip annealing and hot dip galvanizing line.

Referring now to the drawings in detail, a prior art continuous annealing and hot dip galvanizing line is schematically shown in FIG. 1 wherein steel strip 10 is conducted through an annealing furnace 12 and discharged through a snout 14 having its exit end submerged within the molten metal coating bath 16 contained within a zinc pot 18. Guide rollers 20 guide strip 10 along a path through successive furnace zones including a preheating and cleaning zone 22, a fast heating zone 24, a soaking zone 26, a slow cooling zone 28 and a fast cooling zone 30. A controlled or reducing atmosphere is contained in the furnace and in snout 14 to prevent oxidation of the strip surface before entering the molten coating metal in the conventional manner.

The strip 10 passes around a sink roll 32 submerged within the molten metal, then upwardly past a pair of offset deflector rolls 34, 36 to immerge from the bath and pass between an opposed pair of air knives or coating thickness control nozzles 38, through a cooling chamber 40, and around a top, cooled guide roll 42. The unsupported length of strip above the top deflector roll 36 is sufficient for the molten coating metal to be solidified before contacting the chilled guide roll 42 which may be up to 100 feet or more above the surface of the bath 16.

Figure 2:
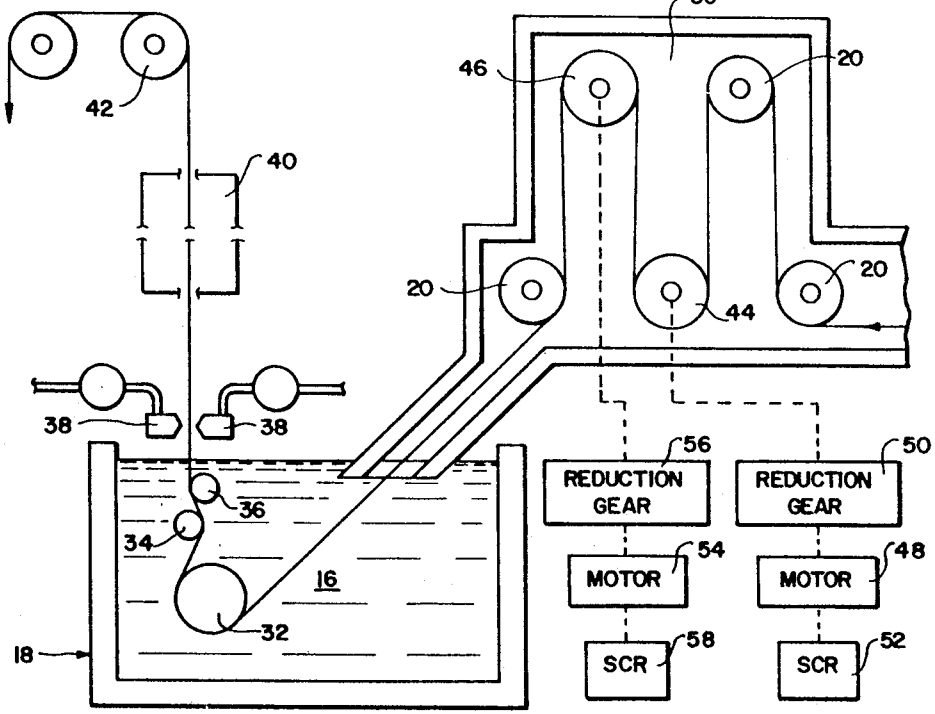
FIG. 2 is an enlarged elevation view, in section, schematically showing a portion of the structure of FIG. 1 and embodying the present invention

The improved tension control system of the present invention is shown in FIG. 2 wherein two of the conventional guide rolls in the final or fast cooling section 30 of the furnace have been replaced by bridle rolls 44, 46. Preferably rolls 44, 46 are arranged in succession along the path of strip 10 through the chamber, with the length of strip between the two rolls being exposed for cooling in the same manner as in the prior art furnace, described above. For example, the vertical distance between the axes of rotation of rolls 44, 46 may be 30 feet and the diameter of the individual bridle rolls may be up to 60 inches; thus, it is apparent that this schematic showing of FIG. 2 is not to scale, with bridle rolls 44, 46 being shown oversized to more clearly distinguish them from the conventional guide rolls 20 employed throughout the furnace. The spacing between the rolls 44, 46 along the strip path preferably is at least about five times the bridle roll diameter.

Each bridle roll 44 is directly driven by a motor and reduction gear drive, with a separate silicon controlled rectifier controller employed to control the motor drive for each of the bridle rolls. Thus, bridle roll 44 is driven by a first motor 48 and reduction gear 50, with motor 48 being controlled by SCR controller 52 while bridle roll 46 is driven by motor 54 and reduction gear 56, with motor 54 being controlled by SCR controller 58.

Rolls 44 and 46 may be of any suitable, conventional construction, with a preferred construction including a cylindrical roll body formed from a cast nodular iron material with its outer surface coated with tungsten carbide to provide a highly wear resistant contact surface and a high coefficient of friction with the moving steel strip.

The annealed strip 10 passes directly from the final fast cool section of the furnace into the molten coating metal, and it is critical that the strip be at the desired temperature within relatively narrow limits as it enters the coating metal. For example, in a hot dip galvanizing operation, the strip normally enters the molten zinc in the pot 18 at a temperature of about 850° F., or just slightly below the temperature of the molten metal in the pot. At the same time, the strip temperature in furnace chamber or zone 26 may be about 1400° F., and incapable of withstanding tensile loads of the magnitude desirable in the coated strip above the coating pot without producing undesirable elongation and distortion in the strip at such higher temperatures.

Existing annealing furnaces, or lines equipped with new furnaces may be adapted to employ the broad base bridle without modifying the structure of the fast cooling chamber 30 so that the strip enters the coating metal at the desired temperature without any modification to operating procedures of the furnace. Use of a conventional two- or three-roll close coupled bridle in this environment would require substantially enlarging the enclosure with a consequent effect on the cooling of the strip passing therethrough.

The primary advantage of the broad base bridle described above is derived from the better load sharing between the respective bridle rolls as a result of the completely independent drive and control for the respective rolls. This improvement in load sharing to produce the desired increase in tensile load in the strip results in a more stable or uniform tensile load and a consequent reduction in slippage and improved tracking through the furnace. Further, the more uniform tensile load resulting from the dual controls and drive of the respective bridle rolls reduces strip flutter and undulations in the vertical run of the coated strip above the zinc pot and produces an improved coating and higher quality finished product. The substantial spacing between the two bridle rolls also contributes to the improved load sharing and reduction in slippage.

Figure 3:
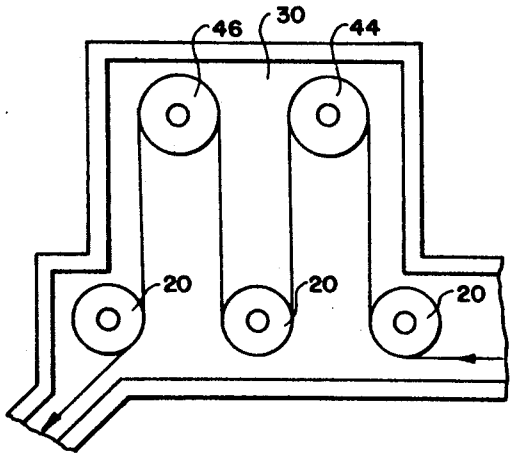
FIG. 3 is a view of a portion of the structure shown in FIG. 2 and illustrating an alternate embodiment of the invention.

While the bridle rolls 44 and 46 are illustrated in FIG. 2 as being located so that the strip passes around their surfaces in succession, it should be apparent that one or more guide rolls 20 might be positioned intermediate the two bridle rolls along the path of the strip through the final cooling chamber as shown in FIG. 3. It is also believed apparent that more than two such bridle rolls might be employed, if desired, to achieve even further strip stability and load uniformity.

While a preferred embodiment of the invention has been disclosed and described in detail, it should be apparent that the invention is not so limited and it is intended to include all embodiments of the invention which would be apparent to one skilled in the art and which come within the spirit and scope of the invention.

What is claimed is:

1. In a continuous hot dip metal strip coating line in which a running length of metal strip is annealed in a continuous annealing furnace and passed from the furnace in a controlled atmosphere through a sealed chute into a bath of molten coating metal, then upwardly from the bath through a coating weight control zone and a cooling zone to permit the molten coating metal carried on the strip to solidify before passing over a top guide roll, the annealing furnace including a plurality of connected chambers in which the moving strip is successively heated, soaked and cooled, and held at various temperatures before passing into the coating bath at a predetermined elevated temperature, each furnace chamber having mounted therein a plurality of spaced guide rolls over which the moving strip passes to define a path to provide a predetermined length of strip in each chamber, the improvement comprising bridle means in the final cooling chamber of said annealing furnace for controlling the tensile load in the strip entering the metal coating bath, said bridle means including a plurality of bridle rolls mounted in said final cooling chamber, separate motor means connected with and driving each said bridle roll, and separate motor control means including a SCR controller connected with and controlling each said motor means, each of said plurality of bridle rolls being mounted for rotation about an axis parallel to the axes of said guide rolls and cooperating with said guide rolls to define a portion of the strip path through said final cooling chamber, said bridle rolls being spaced apart along said strip path a distance at least five times their diameter, said separate motor control means being operable to independently control rotation of the associated bridle roll to maintain a uniform tensile load in the annealed strip passing from the final cooling chamber of the furnace into the molten coating metal.

2. The invention defined in claim 1 wherein said bridle rolls comprise a cast nodular iron roll body having a tungsten carbide coating thereon.

3. In a continuous hot dip metal strip coating line in which a running length of metal strip is annealed in a continuous annealing furnace and passed from the furnace in a controlled atmosphere through a sealed chute into a bath of molten coating metal, then upwardly from the bath through a coating weight control zone and a cooling zone to permit the molten coating metal carried on the strip to solidify before passing over a top guide roll, the annealing furnace including a plurality of connected chambers in which the moving strip is successively heated, soaked and cooled, and held at various temperatures before passing into the coating bath at a predetermined elevated temperature, each furnace chamber having mounted therein a plurality of spaced guide rolls over which the moving strip passes to define a path to provide a predetermined length of strip in each chamber, the improvement comprising bridle means in the final cooling chamber of said annealing furnace for controlling the tensile load in the strip entering the metal coating bath, said bridle means including a plurality of bridle rolls mounted in said final cooling chamber with one of said guide rolls being positioned between successive bridle rolls along said path, separate motor means connected with and driving each said bridle roll, separate motor control means including a SCR controller connected with and controlling each said motor means, each of said plurality of bridle rolls being mounted for rotation about an axis parallel to the axes of said guide rolls and cooperating with said guide rolls to define a portion of the strip path through said final cooling chamber, said bridle rolls being spaced apart along said strip path a distance at least substantially equal to the spacing of successive guide rolls in said final cooling chamber, said separate motor control means being operable to independently control rotation of the associated bridle roll to maintain a uniform tensile load in the annealed strip passing from the final cooling chamber of the furnace into the molten coating metal.

4. The invention defined in claim 3 wherein said bridle rolls comprise a cast nodular iron roll body having a tungsten carbide coating thereon.

5. The invention defined in claim 3 wherein said bridle means comprises two bridle rolls each driven by a separate motor means.

* * * * *